US006843079B2

(12) United States Patent
Hird

(10) Patent No.: US 6,843,079 B2
(45) Date of Patent: Jan. 18, 2005

(54) LAUNDRY APPLIANCE

(75) Inventor: Malcolm John Hird, Abergavenny (GB)

(73) Assignee: Dyson Limited, Wiltshire (GB)

( * ) Notice: Subject to any disclaimer, the term of this patent is extended or adjusted under 35 U.S.C. 154(b) by 325 days.

(21) Appl. No.: 10/221,671

(22) PCT Filed: Mar. 14, 2001

(86) PCT No.: PCT/GB01/01092

§ 371 (c)(1),
(2), (4) Date: Sep. 16, 2002

(87) PCT Pub. No.: WO01/71083

PCT Pub. Date: Sep. 27, 2001

(65) Prior Publication Data

US 2003/0061840 A1 Apr. 3, 2003

(30) Foreign Application Priority Data

Mar. 18, 2000 (GB) ..... 0006507

(51) Int. Cl.[7] ..... D06F 23/02

(52) U.S. Cl. ..... 68/13 R; 68/24; 68/58; 68/27; 68/142

(58) Field of Search ..... 68/12.02, 13 R, 68/24, 27, 58, 139, 140, 142

(56) References Cited

U.S. PATENT DOCUMENTS

| | | | | | |
|---|---|---|---|---|---|
| 2,516,656 | A | * | 7/1950 | Smith | 68/131 |
| 2,575,691 | A | * | 11/1951 | Smith | 68/23.7 |
| 2,630,001 | A | * | 3/1953 | Criner | 68/23.5 |
| 4,020,659 | A | * | 5/1977 | Bhavsar | 68/27 |
| 4,156,358 | A | * | 5/1979 | Harrsch | 68/27 |
| D272,668 | S | * | 2/1984 | Percival et al. | D32/29 |
| 4,580,421 | A | * | 4/1986 | Babuin et al. | 68/12.13 |
| 4,711,103 | A | * | 12/1987 | Mori et al. | 68/12.05 |
| 4,742,698 | A | * | 5/1988 | Torita | 68/12.04 |
| 4,794,661 | A | * | 1/1989 | Durazzani | 8/158 |
| 4,916,768 | A | | 4/1990 | Broadbent | |
| 5,025,645 | A | * | 6/1991 | Eck et al. | 68/27 |
| 5,144,819 | A | * | 9/1992 | Hiyama et al. | 68/12.04 |
| 5,156,025 | A | * | 10/1992 | Frucco | 68/12.02 |
| 5,211,037 | A | * | 5/1993 | Adamski et al. | 68/12.16 |
| 5,231,857 | A | * | 8/1993 | Rew et al. | 68/134 |
| 6,311,527 | B1 | * | 11/2001 | Monteiro et al. | 68/140 |
| 6,381,790 | B2 | * | 5/2002 | Monteiro et al. | 8/158 |

FOREIGN PATENT DOCUMENTS

| | | |
|---|---|---|
| EP | 0 688 894 A1 | 12/1995 |
| EP | 0 742 307 A1 | 4/1996 |
| GB | 2 001 454 A | 1/1979 |
| GB | 2 141 742 A | 1/1985 |
| GB | 2 337 274 A | 11/1999 |
| WO | 99/58753 | 11/1999 |

OTHER PUBLICATIONS

European Patent Office 326,800 Jan. 1989.*

* cited by examiner

*Primary Examiner*—Frankie L. Stinson
(74) *Attorney, Agent, or Firm*—Morrison & Foerster LLP

(57) ABSTRACT

A laundry appliance comprises a drum for receiving articles to be laundered, the drum comprising at least two rotatable drum portions and a drive capable of operating the drum in a plurality of different drum modes. The drum modes include a mode in which the rotatable drum portions are driven so as to cause relative rotation between them. A controller (100) controls the appliance to perform a plurality of different wash programs, each wash program having an associated drum mode. Each wash program comprises a sequence of stages, with a drum mode being associated with each stage. The drum modes can differ in respect of (a) use (or non-use) of relative rotation between the drum portions (b) the ratio of time that the drum portions rotate compared to the time that they are at rest, and (c) the speed at which the drum portions are rotated. The intensity of a wash program can be varied, inter alia, by varying the length of the wash stage.

13 Claims, 6 Drawing Sheets

400

PREWASH

| STEP No. | DESCRIPTION | MAX TIME (m-min, s-secs) | DRUM MODE | | | | | |
|---|---|---|---|---|---|---|---|---|
| | | | COTTN | SYNTH | DELIC | WOOL | CARE+ | DUVET |
| 1 | FILL | 10m | NA | | | | | |
| 2 | PREHEAT | 5m | CRN | | | | | NA |
| 3 | WASH | 5m | CR | | | | | NA |
| 4 | PRE-D RINSE | 5m | NA | | | | | |
| 5 | DRAIN | 2m | – | | | | | |

400

MAIN WASH

| STEP No. | DESCRIPTION | MAX-TIME (m-mins, s-secs) | DRUM MODE | | | | | |
|---|---|---|---|---|---|---|---|---|
| | | | COTTN | SYNTH | DELIC | WOOL | CARE+ | DUVET |
| 1 | FILL TO TEMP | 10m | NA | | | GA | | NA |
| 2 | HEAT | 50m | NA | GA | | SGA | | NA |
| 3 | WASH | 8m(N)*, 6m(L), 10m(H)*, 30m(DUVET) | CR | | | CRN | | NA |
| 4 | PRE-D RINSE | 5m | – | | SKIP | | | |
| 5 | PRE-D ACTION | 1m | NA | | | | | SKIP |
| 6 | DRAIN | 2m | – | | | | | |

* EXCEPT FOR SPECIAL CASE FOR COTTON 60°C WASH ONLY: 10m(N), 12m(H).

*Fig. 6*

400

RINSE 1,2,3

| STEP NO. | DESCRIPTION | MAX TIME (m-mins, s-secs) | DRUM MODE | | | | | |
|---|---|---|---|---|---|---|---|---|
| | | | COTTN | SYNTH | DELIC | WOOL | CARE+ | DUVET |
| 1 | FILL | 10m | NA | GA | | | | NA |
| 2 | RINSE | 90s, 120s(DUVET) | NA | GA | | | | NA |
| 3 | DRAIN DISTRIBUTE | 2m | D | | | | | |
| 4 | SPIN | 30s | IS | SKIP | | | | IS |

400

FINAL RINSE

| STEP NO. | DESCRIPTION | MAX TIME (m-mins, s-secs) | DRUM MODE | | | | | |
|---|---|---|---|---|---|---|---|---|
| | | | COTTN | SYNTH | DELIC | WOOL | CARE+ | DUVET |
| 1 | FILL | 10m | NA | GA | | | | NA |
| 2 | RINSE | 2m | NA | GA | | | | NA |

400

FINAL SPIN

| STEP NO. | DESCRIPTION | MAX TIME (m-mins, s-secs) | DRUM MODE | | | | | |
|---|---|---|---|---|---|---|---|---|
| | | | COTTN | SYNTH | DELIC | WOOL | CARE+ | DUVET |
| 1 | DRAIN DISTRIBUTE | 2m | D | | | | | |
| 2 | SPIN | 10m | FS | | | | | |

*Fig. 7*

KEY

| CODE | OPTION SELECTED |
|---|---|
| (L) | LIGHT SOIL |
| (N) | NORMAL SOIL |
| (H) | HEAVY SOIL |

| MOTOR ACTION CODE | DESCRIPTION |
|---|---|
| CR | COUNTER ROTATION |
| CRN | COUNTER ROTATION NORMAL |
| D | DISTRIBUTION |
| FS | FINAL SPIN |
| GA | GENTLE ACTION |
| IS | INTERMEDIATE SPIN |
| NA | NORMAL ACTION |
| SGA | SUPER GENTLE ACTION |

*Fig. 8*

LAUNDRY APPLIANCE

FIELD OF THE INVENTION

The present invention relates to a laundry appliance such as a washing machine or washer-dryer and to a control apparatus for such a machine.

BACKGROUND OF THE INVENTION

Conventional washing machines operate by agitating textile articles within a rotating drum in the presence of water and detergent so that dirt is released from the fibres of the textile articles into the water. The agitation is caused, in the case of front-loading washing machines, by the rotation of the drum about a generally horizontal axis so that the textile articles tumble over one another and rub against each other and against the walls of the drum. However, the rotational speed of the drum is limited because, if the speed is too high, the textile articles will merely be pressed under centrifugal forces against the interior walls of the drum. The articles then rotate with the drum and no agitation with respect to the drum or with respect to other articles is achieved. The amount of agitation which can be applied to the textile articles by front-loading washing machines is therefore limited. This means that, in order to achieve a specific standard of cleanliness, the machine must operate for a minimum period of time.

International Patent Application WO99/58753 describes a washing machine in which the drum comprises two rotatable drum portions which are driven in such a way that relative rotation is produced between the drum portions. The relative rotation between the drum portions gives a more vigorous agitation of the articles within the drum, treating them more intensively than they would be in conventional apparatus and consequently dirt is released from the textile articles at a higher rate than in other machines.

SUMMARY OF THE INVENTION

The present invention seeks to provide an improved laundry apparatus.

Accordingly, a first aspect of the invention provides a laundry appliance comprising a drum for receiving articles to be laundered, the drum comprising at least two rotatable drum portions and a drive capable of operating the drum in a plurality of different drum modes, including a drum mode in which the rotatable drum portions are driven so as to cause relative rotation between the adjacent rotatable drum portions, and a controller which is capable of controlling the appliance to perform a plurality of different wash programmes, each wash programme having an associated drum mode.

This has the advantage that each wash programme uses a drum mode which is appropriate for the type of load that is to be washed during that wash programme.

Preferably, in one of the wash programmes, the controller controls the drive to operate in a drum mode in which the drum portions are not rotated relative to one another at any point during the wash programme. This has the advantage that the drum can accommodate a load of the type which would not normally be suited to this type of appliance, such as a duvet.

The portions of the drum can be rotated in opposite directions at the same or different speeds. Alternatively, each of the portions of the drum can be rotated at a different speed in the same direction.

Preferably the appliance has a control panel for allowing a user to select an intensity for the chosen wash programme, such as when clothes are more heavily or more lightly soiled than normal. The controller is arranged to vary, in use, the intensity of the wash programme in accordance with the selection made by a user. The intensity of the wash programme can be varied by varying the length of the wash portion of the wash programme, varying the ratio of time during which the drum portions are rotated relative to one another compared to the time during which the drum portions are not rotated or varying the speed of relative rotation between the drum portions. The latter two options have the advantage of allowing the wash intensity to be varied without increasing the length of the wash programme.

BRIEF DESCRIPTION OF THE DRAWINGS

A further aspect of the invention provides a control apparatus for the laundry appliance.

Embodiments of the invention will now be described with reference to the accompanying drawings, in which:

FIGS. 6 and 7 are tables which give details of the wash programmes performed by the machine of FIG. 1 and FIG. 8 is a key for these tables.

DETAILED DESCRIPTION OF THE INVENTION

Figure 1:
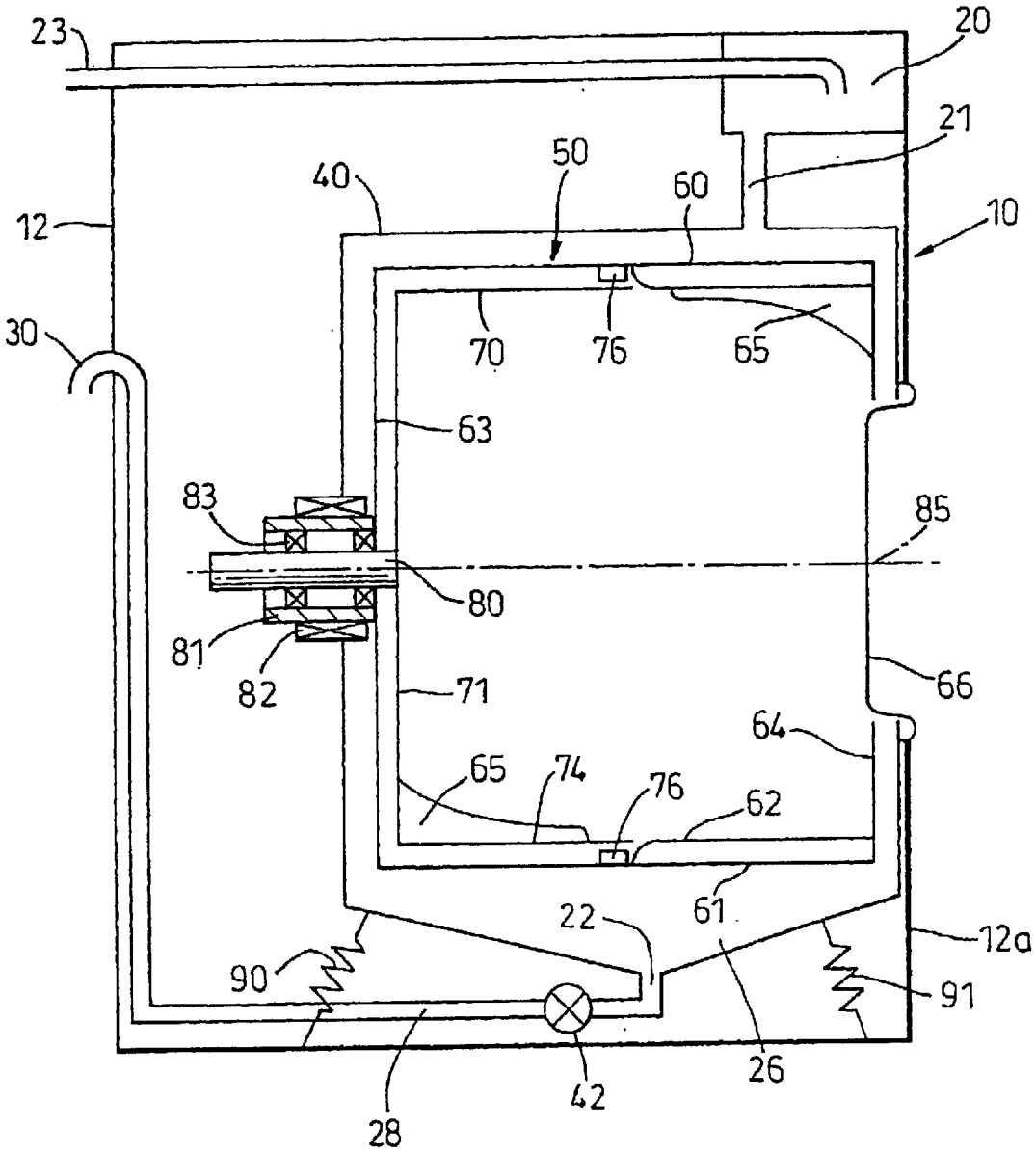
FIG. 1 is a cross-sectional view of a washing machine embodying the present invention.

FIG. 1 shows a washing machine 10 which includes an outer casing 12 in which a stationary tub 40 is located. A drum 50 is mounted inside the tub 40 so as to be rotatable about an axis 85. The tub 40 is watertight except for an inlet 21 and outlet 22. The washing machine 10 includes a soap tray 20 capable of receiving detergent in a known manner. At least one water inlet 23 communicates with the soap tray 20 and is provided with suitable means for connection to a water supply within the environment in which the washing machine 10 is to be used. A conduit 21 is provided between the soap tray 20 and the tub 40 so as to allow water introduced via the inlet 23 to enter the tub 40. The tub 40 has a sump 26 located beneath the drum 50. A drainage pipe 28 communicates with the sump 26 and leads to a water outlet 30 via which water can be discharged from the washing machine 10. A pump 42 is provided to allow water to be pumped from the sump 26 to the water outlet 30 at appropriate stages of the washing cycle carried out by the washing machine 10.

The drum 50 is rotatably mounted about the axis 85 by way of a shaft 80. The shaft 80 is mounted in a known manner, allowing the tub 40 to remain stationary whilst the drum 50 is rotatable with the shaft 80. The shaft 80 is rotatably driven by a motor (not shown) mounted within the outer casing 12 of the washing machine 10. A door 66 is located in the front panel 12*a* of the outer casing 12 to allow access to the interior of the drum 50. It is via the door 66 that a wash load can be deposited within the drum 50 before a wash cycle commences and removed from the drum 50 at the end of the wash cycle.

Drum 50 comprises two portions 60, 70 which are mounted such that they can be rotated with respect to one another. A drum of this type is described more fully in International Patent Application WO99/58753. Typically the drum portions 60, 70 are rotated in opposite directions to one another, i.e. one portion clockwise, one counter-clockwise, but they can also be rotated together in the same direction. The drum 50 is mounted in a cantilever fashion on the wall of the tub 40 remote from the door 66. The first outer rotatable portion 60, is supported on a hollow cylindrical shaft 81. An angular contact bearing 82 is located between the rear wall of the tub 40 and the hollow cylindrical shaft 81. The outer rotatable portion 60 is dimensioned so as to substantially fill the interior of the tub 40. More specifically, the outer rotatable portion 60 has a generally circular rear wall 63 extending from the hollow cylindrical shaft 81 towards the cylindrical wall of the tub 40, a generally cylindrical wall 61 extending generally parallel to the cylindrical walls of the tub 40 from the rear wall 63 towards the front wall of the tub 40, and a generally annular front face 64 extending from the cylindrical wall 61 towards the door 66. Sufficient clearance is allowed between the walls 61, 63, 64 of the outer rotatable portion 60 and the tub 40 to prevent the outer rotatable portion 60 from coming into contact with the tub 40 when the drum 50 is made to spin.

An inner cylindrical wall 62 is also provided on the interior of the cylindrical wall 61 of the outer rotatable portion 60. The inner cylindrical wall 62 extends from a point which is substantially midway between the rear wall 63 and the front face 64 to the front face 565. The space between the interior cylindrical wall 62 and the cylindrical wall 61 is hollow but, if desired, could be filled with a strengthening material. In this event, the strengthening material must be lightweight. The provision of parallel cylindrical walls 61, 62 in the portion of the outer rotatable portion 60 closest to the front face 64 provides strength to the whole of the outer rotatable portion 60 whilst reducing the internal diameter of the outer rotatable portion 60 in this region.

The inner rotatable portion 70 is supported on a central shaft 80, which in turn, is supported by deep groove bearings 83 located between the central shaft 80 and the hollow cylindrical shaft 81. The inner rotatable portion 70 essentially comprises a generally circular rear wall 71 extending from the central shaft 80 towards the cylindrical wall of the tub 40, and a cylindrical wall 74 extending from the periphery of the rear wall 71 towards the front wall of the tub 40. The diameter of the cylindrical wall 74 of the inner rotatable portion 70 is substantially the same as the diameter of the inner cylindrical wall 62 of the outer rotatable portion 60. The cylindrical wall 74 of the inner rotatable portion 70 is dimensioned so that its distal end approaches the end of the cylindrical wall 62 closest to it. It is advantageous to keep the gap between these two cylindrical walls 62, 74 as small as possible. An annular sealing ring 76 is located on the cylindrical wall 61 of the outer cylindrical portion 60 immediately adjacent to the end of the inner cylindrical wall 62 closest to the inner cylindrical portion 70 so as to provide support for the distal end of the cylindrical wall 76 thereof.

Figure 2:
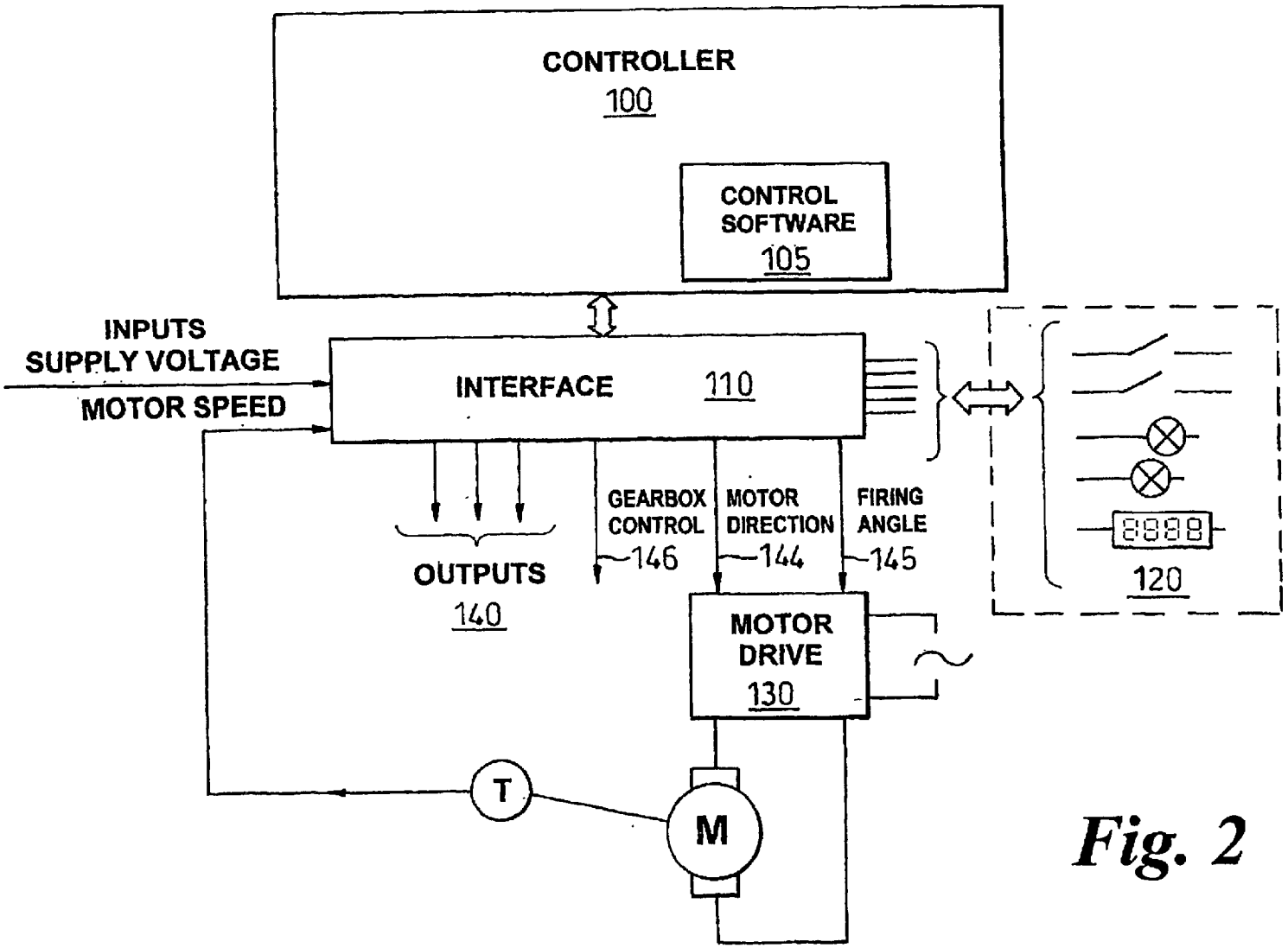
FIG. 2 shows a control system for the machine of FIG. 1.

FIG. 2 shows part of the control system of the machine 10. A controller 100 operates according to a control program stored on a non-volatile memory 105. The controller 100 is preferably implemented in the form of a microcontroller but other ways of implementing the controller, such as an implementation entirely in hardware, will be apparent to the reader and are intended to fall within the scope of this invention.

An interface 110 interfaces the controller 100 to other parts of the machine 10. Sensors placed on the machine return signals to the interface 110. The sensors include a water temperature sensor for monitoring temperature of the wash water in the sump of the machine 10 and a motor speed sensor. The interface 110 also outputs signals to control operation of the display 220 to display text messages and signals to control the illumination of indicator lamps 215, 265 on the control panel 120. Interface 110 also receives inputs from each of the control buttons 210, 230, 240, 250, 260 on the control panel 120 which allows the controller 100 to determine what button a user has pressed. The interface 110 also outputs a set of control signals 140 to control the operating state of various parts of the machine, such as the door lock, water inlet valves, and the motor M. In a well-known manner, the control software 105 controls operation of the machine according to the inputs it receives and issues outputs 140 for controlling various parts of the machine.

The speed of motor M is controlled on the basis of the monitored supply voltage and motor speed inputs to the interface and an output signal 145 to motor drive 130. Control signal 145 controls the firing angle of the triac (or other power switching device) in the motor drive circuit 130. Another output signal 144 controls the direction of rotation of the motor M and a further output signal 146 controls the state of the gearbox. The state of the gearbox determines whether the drum portions 60, 70 are rotated in unison or whether they are rotated relative to one another. Motor M can be used to drive both drum portions 60, 70 or two separate motors may be provided, one motor being used to drive each of the drum portions 60, 70.

Figure 3:
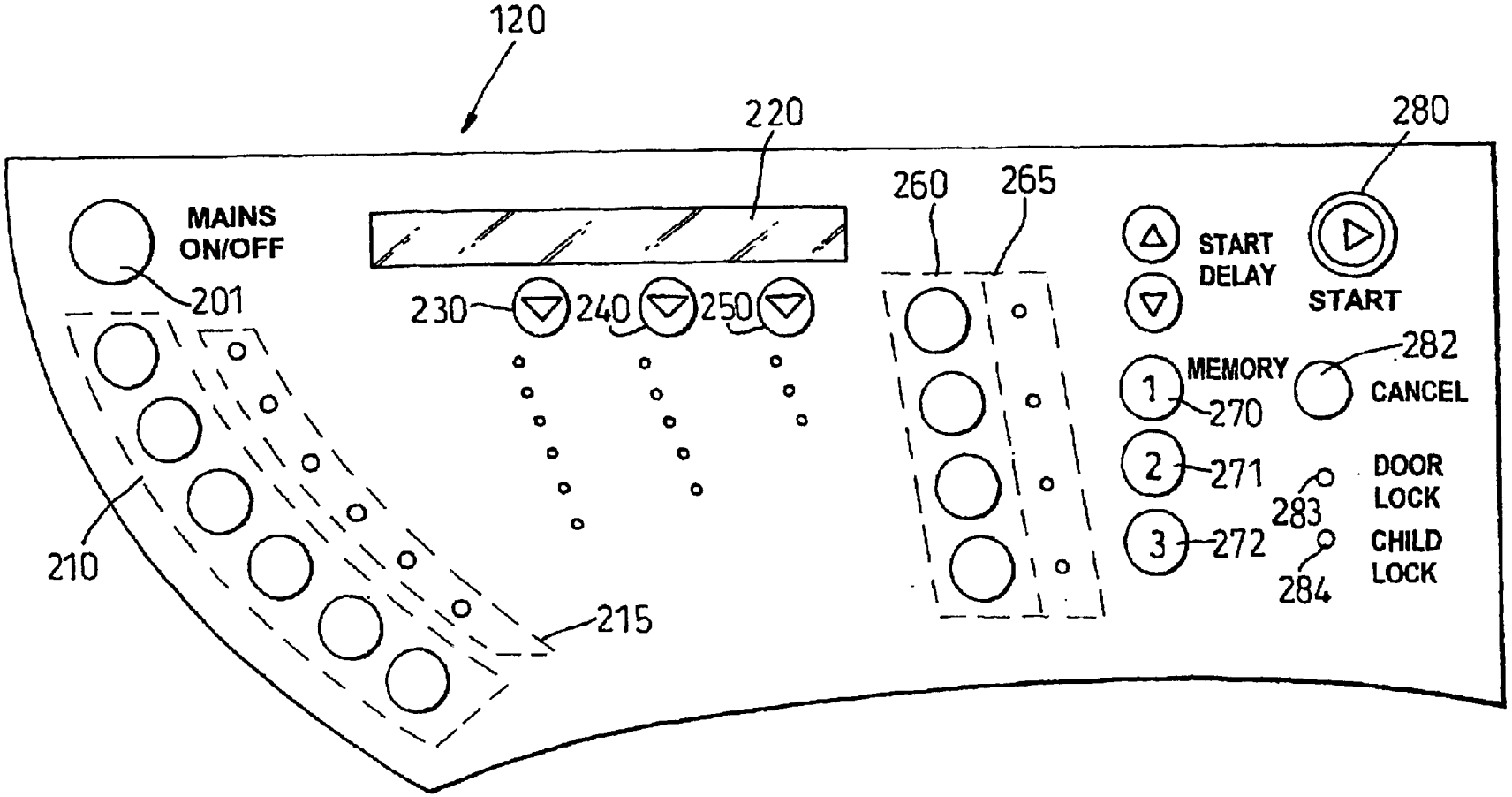
FIG. 3 shows one form of control panel for the, machine of FIG. 1.

FIG. 3 shows one embodiment of control panel 120 in more detail. It will be appreciated that the control panel can vary from the one shown here. For example, the control panel 120 may provide a different range of options, the type of control may vary e.g. push button, touch-sensitive control, switch, rotatable control knob or slider. Also, the range and type of visual indicators can vary, e.g. the indicators can include LEDs, an LCD or electroluminescent display.

The control panel of FIG. 3 includes an on/off button 201 to turn the mains power supply to the machine on/off; a set of control buttons 210 and associated indicators 215 for selecting the wash programme (cotton, synthetics, wool, delicates etc.); a control button 230 and an associated set of indicators for selecting the wash temperature (20–85° C.); a control button 240 and an associated set of indicators for selecting spin speed (0–1600 rpm); a control button 250 and an associated set of indicators for selecting wash intensity (light, normal, heavy); a set of control buttons 260 and an associated set of indicators 265 for selecting special features (minimum crease, pre-wash, extra rinse etc.); a plurality of memory buttons 270, 271, 272 for selecting a combination of stored settings; a start button 280 for starting the machine according to the settings programme by a user, and a cancel button 282. A further indicator 283 indicates when the door 30 of the machine is locked and indicator 284 indicates when the child lock mode is active.

An LCD display 220 displays text messages at various stages during operation of the machine to help a user select programme settings and to indicate the progress of the machine through the wash cycle.

There are two basic types of drum mode: a counter-rotating mode in which the drum portions 60, 70 are rotated relative to one another and a normal mode in which the drum portions 60, 70 are rotated in unison in the same direction in a conventional manner.

The following table gives details of five drum modes. Each drum mode comprises a repeated sequence of four steps. For example, the 'Counter Rotation' operation performs: a first step which counter-rotates the drum portions 60, 70 with respect to one another for 13*s*; a second step which rests for 6*s* with no drum action; a third step which counter-rotates the drum portions 60, 70 with respect to one another for 13*s* in the opposite direction to that used in action 1; and a fourth step which rests for 6*s* with no drum action. Clearly, any of the parameters of the drum operations defined here could be varied as appropriate.

| Drum Mode | Step no. | Duration (s) | Drum speed (rpm) |
|---|---|---|---|
| Counter Rotation (CR) | 1 | 13 | 52 |
| | 2 | 6 | 0 |
| | 3 | 13 | −52 |
| | 4 | 6 | 0 |
| Counter Rotation Normal (CRN) | 1 | 10 | 52 |
| | 2 | 32 | 0 |
| | 3 | 10 | −52 |
| | 4 | 32 | 0 |
| Normal Action (NA) | 1 | 11 | 52 |
| | 2 | 5 | 0 |
| | 3 | 11 | −52 |
| | 4 | 5 | 0 |
| Gentle Action (GA) | 1 | 6 | 52 |
| | 2 | 12 | 0 |
| | 3 | 6 | −52 |
| | 4 | 12 | 0 |
| Super Gentle Action (SGA) | 1 | 6 | 52 |
| | 2 | 27 | 0 |
| | 3 | 6 | −52 |
| | 4 | 27 | 0 |

Figure 4A:
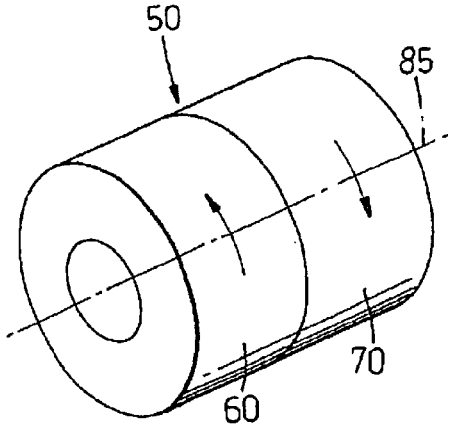
FIGS. 4A–4C show one drum mode performed by the machine of FIG. 1.
Figure 5A:
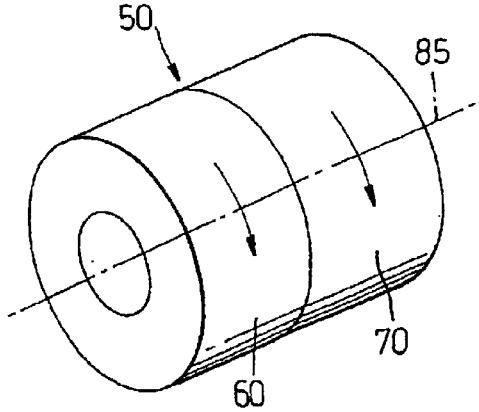
FIGS. 5A–5C show another drum mode performed by the machine of FIG. 1.
Figure 4B:
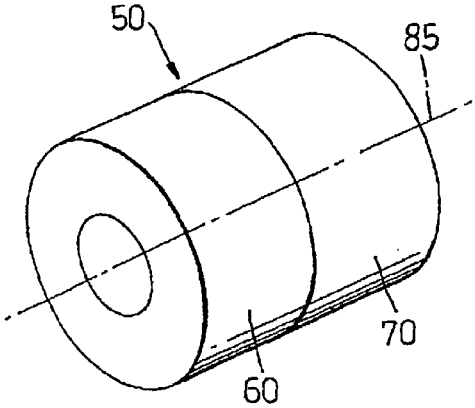
Figure 5B:
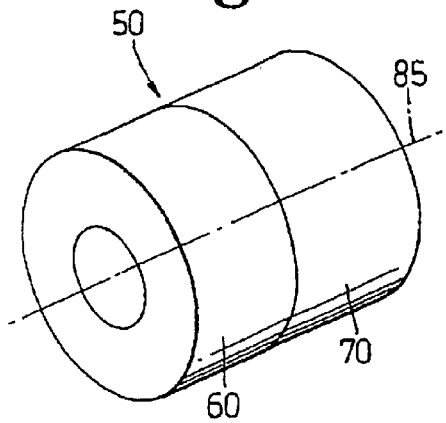
Figure 4C:
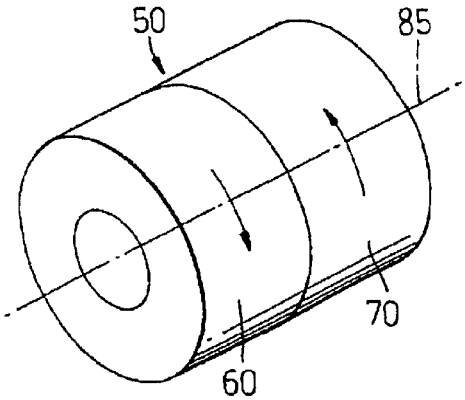
Figure 5C:
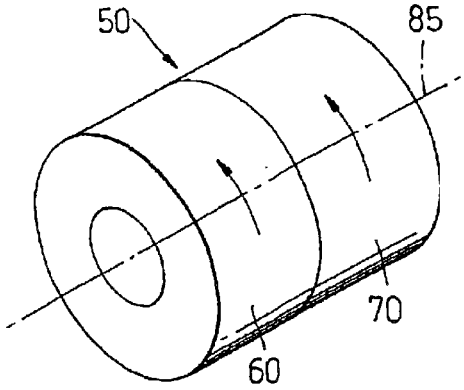

FIGS. 4A–4C illustrate steps numbers 1–3 for the counter-rotating drum modes. The drum portions 50, 60 firstly rotate in opposite directions (FIG. 4A), then rest (FIG. 4B), then rotate in opposite directions (FIG. 4C) with each drum portion 60, 70 rotating in a different direction to that in FIG. 4A and finally rest (not shown.) FIGS. 5A–5C illustrate actions for the normal drum modes. The drum portions 60, 70 firstly rotate in unison in the same direction (FIG. 5A), then rest (FIG. 5B), then rotate in unison (FIG. 5C) in the opposite direction to that in FIG. 5A and finally rest (not shown.)

In the above table, the Counter Rotations (CR) and Counter Rotation Normal (CRN) modes differ in the ratio of time when the drums are rotating (and therefore agitating the load) and when the drums are at rest. In the CR mode the drums are rotating for roughly twice the time that they are at rest whereas in the CRN mode the drums are at rest for roughly three times the time that they are rotating. Similarly, with the normal modes, the modes differ in the ratio of time when the drums are rotating (and therefore agitating the load) and when the drums are at rest. While the modes detailed above all operate at the same drum speed of 52 rpm it is possible to vary the drum speed between modes to vary the amount of agitation that these modes provide.

FIGS. 6 and 7 are tables which give full details of a set of wash programmes performed by the machine 10 and FIG. 8 is a key for these tables. A complete wash cycle comprises the following stages: prewash (if the user has selected this), main wash, rinse, final rinse and final spin. Each of these stages comprises a number of steps. During each step the machine operates with a combination of an amount of water, a water temperature and a drum mode 400 detailed in the tables. As is well-known with conventional wash programmes, the water temperature that is used during the wash programme varies according to the type of fabric being washed, with robust fabrics such as cotton being washed at a higher temperature than delicates.

During the stages of the wash cycle, and particularly during the main wash (see "Main Wash" step no. 3, FIG. 6) the machine operates with a drum mode which is dependent on the wash programme. The most robust fabric types such as cottons, synthetics and dedicates use the CR drum mode (long burst of counter-rotation followed by a short rest); wool and care+ use the CRN drum mode (short burst of counter-rotation followed by a long rest) and the duvet programme does not use counter-rotation at all, since the load comprises one large article which is expected to fill the drum, conditions which are not suited to the use of a counter-rotating drum mode. The length of the wash step (see "Main Wash" step no. 3, FIG. 6) varies according to the amount of soiling of the articles in the wash load: 4 minutes for light soiling, 6 minutes for normal soiling and 10 minutes for heavy soiling. A user selects the intensity of the wash via control 250 on the control panel 120. However, as an alternative to varying the length of time for the wash step, the controller can vary the amount of agitation by varying the drum mode. Increased agitation can be provided by using a drum mode which rotates the drum portions 60, 70 at a higher speed relative to one another or with a longer ratio of rotation time to rest time.

Variations to the described embodiments are intended to fall within the scope of the present invention. While five drum modes are described here, it is possible to provide more modes which vary in the amount of agitation they apply to the wash load. The modes can vary in the ratio of rotating time to rest time and/or speed of rotation. The drum 50 can comprise more than just the two rotatable portions 60, 70. Three or more separately rotatable portions can be provided, all lying alongside one another along the axis of rotation.

What is claimed is:

1. A laundry appliance comprising:

a drum for receiving articles to be laundered, comprising at least two rotatable drum portions and a drive capable of operating the drum in a plurality of different drum modes, including a drum mode in which the rotatable drum portions are driven so as to cause relative rotation between adjacent rotatable drum portions, and a controller which is capable of controlling the appliance to perform a plurality of different wash programs, each wash program having an associated drum mode.

2. A laundry appliance according to claim 1, wherein each wash program comprises a sequence of stages, and wherein a drum mode is associated with each stage.

3. A laundry appliance according to claim 1, wherein the drum modes comprise a sequence of steps in which, in one of the steps, the drum portions are rotated relative to one another and which, in another of the steps, the drum portions are not rotated, at least two of the drum modes differing in the durations of the steps.

4. A laundry appliance according to claim 1, wherein at least some of the drum modes differ from other drum modes in the speeds at which the drum is rotated.

5. A laundry appliance according to claim 1, wherein, in at least some of the drum modes, the drum portions are rotated in opposite directions to one another.

6. A laundry appliance according to claim 1, wherein, in one of the wash programs, the controller controls the appliance to operate in a drum mode in which the drum portions are not rotated relative to one another at any point during the wash program.

7. A laundry appliance according to claim 1, wherein the controller controls the drum mode according to the load of articles to be laundered in the drum.

8. A laundry appliance according to claim 1, further comprising a control panel for allowing a user to select a wash program, and wherein the controller is responsive to a selection made by a user on the control panel.

9. A laundry appliance according to claim 8, wherein the control panel allows a user to select an intensity for the chosen wash program, and wherein the controller is configured to vary the intensity of the wash program in accordance with the selection made by a user.

10. A laundry appliance according to claim 9, wherein the controller is configured to vary the intensity of the wash program by varying the length of a wash portion of the wash program.

11. A laundry appliance according to claim 9, wherein the controller is configured to vary the intensity of the wash program by varying a ratio of times during which the drum portions are rotated relative to one another to times during which the drum portions are not rotated.

12. A laundry appliance according to claim 9, wherein the controller is configured to vary the intensity of the wash program by varying the speed of relative rotation between the drum portions.

13. A control apparatus for a laundry appliance comprising a drum for receiving articles to be laundered, the drum comprising at least two rotatable drum portions and a drive capable of operating the drum in a plurality of different drum modes, including a drum mode in which the rotatable drum portions are driven so as to cause relative rotation between adjacent rotatable drum portions, the control apparatus being configured to control the appliance to perform a drum portions.

* * * * *